US012241349B2

(12) United States Patent
Maclean et al.

(10) Patent No.: US 12,241,349 B2
(45) Date of Patent: Mar. 4, 2025

(54) METHOD FOR DEPLOYING A WELL PUMP ON AN ELECTRICAL CABLE

(71) Applicant: Schlumberger Technology Corporation, Sugar Land, TX (US)

(72) Inventors: Iain Maclean, Aberdeen (GB); Rubria Garza, Aberdeen (GB); Mike Banda, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/719,888

(22) PCT Filed: May 30, 2023

(86) PCT No.: PCT/US2023/023798
§ 371 (c)(1),
(2) Date: Jun. 14, 2024

(87) PCT Pub. No.: WO2023/230371
PCT Pub. Date: Nov. 30, 2023

(65) Prior Publication Data

US 2024/0418065 A1 Dec. 19, 2024

Related U.S. Application Data

(60) Provisional application No. 63/346,569, filed on May 27, 2022.

(51) Int. Cl.
*E21B 43/12* (2006.01)
*E21B 33/06* (2006.01)

(52) U.S. Cl.
CPC ..... *E21B 43/128* (2013.01); *E21B 33/061* (2013.01)

(58) Field of Classification Search
CPC . E21B 33/12; E21B 23/14; E21B 7/20; E21B 23/001; E21B 43/128; E21B 34/02; E21B 21/10
See application file for complete search history.

(56) References Cited

U.S. PATENT DOCUMENTS 4,440,221 A 4/1984 Taylor
6,328,111 B1 12/2001 Bearden
(Continued)

OTHER PUBLICATIONS

Search Report and Written Opinion of International Patent Application No. PCT/US2023/023798 dated Sep. 18, 2023, 6 pages.

*Primary Examiner* — Zakiya W Bates
(74) *Attorney, Agent, or Firm* — Jeffrey D. Frantz

(57) ABSTRACT

A method of deploying a pump in a well production tubing using an electrical cable includes attaching a downhole barrier valve (DBV) to a spoolable conveyance. The DBV is closed to flow in both directions until a differential pressure across the DBV exceeds a first threshold. The DBV is closed to flow when the differential pressure falls below the first threshold. The DBV is moved to a selected depth in the well by extending the conveyance through a lubricator attached to a wellhead at an upper end of the production tubing. The spoolable conveyance is withdrawn from the well. The pump is attached to the electrical cable and is moved through the wellhead and the production tubing by extending the cable until the pump reaches a selected setting depth in the well.

7 Claims, 3 Drawing Sheets

(56) References Cited

U.S. PATENT DOCUMENTS

| | | | | |
|---|---|---|---|---|
| 6,520,255 | B2 * | 2/2003 | Tolman | E21B 43/117 166/177.5 |
| 10,036,210 | B2 | 7/2018 | Maclean | |
| 2008/0141826 | A1 * | 6/2008 | Marya | C22C 38/001 75/331 |
| 2008/0202748 | A1 | 8/2008 | Bussear | |
| 2014/0158380 | A1 | 6/2014 | Varkey | |
| 2020/0270966 | A1 | 8/2020 | Moyes | |

* cited by examiner

METHOD FOR DEPLOYING A WELL PUMP ON AN ELECTRICAL CABLE

CROSS REFERENCE TO RELATED APPLICATIONS

This application is a National Stage Entry of International Application No. PCT/US2023/023798, filed May 30, 2023, which claims the benefit of U.S. Provisional Application No. 63/346,569, entitled "METHOD FOR DEPLOYING A WELL PUMP ON AN ELECTRICAL CABLE," filed May 27, 2022, the disclosure of which is hereby incorporated herein by reference.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of well pumps. More specifically, the disclosure relates to methods for deploying well pumps on electrical cable.

Well pumps such as electric submersible pumps (ESPs) are used for among other purposes lifting fluids in a subsurface well when energy in a subsurface fluid reservoir is insufficient to lift such fluids to the surface. In wells used, for example, to produce hydrocarbons from a subsurface reservoir, ESPs may be deployed on a production tubing, that is, a length of conduit or pipe of relatively small diameter (e.g., 2⅜ inches or 2⅞ inches) nested within a protecting casing or liner disposed in the subsurface rock formations penetrated by the well. Electrical power and control/data signals may be communicated along an electrical cable deployed in the well along with the production tubing and the ESP.

Smaller diameter ESPs and techniques have been developed to deploy ESPs on an electrical cable, slickline or coiled tubing with the production tubing already installed in the well. See, for example. U.S. Pat. No. 10,036,210 issued to Maclean et al. Referring to FIG. 1, an ESP 20 is shown attached to one end of an electrical cable 17A such as a tubing encapsulated cable. The ESP 20 may comprise an annular seal such as a packer 26 along its length to close an annular space between the ESP 20 and an interior wall of the production tubing 19. An ESP fluid intake 26 is located on one side of the packer 26, and the ESP discharge 22 is located on the other side of the packer 26 such that fluid is lifted by the ESP 20 into the production tubing 19 to surface.

To install the ESP 20 using known techniques, it is necessary first to seal the well using, for example, a bridge plug, multiple bridge plugs or any similar seal (not shown) disposed in the production tubing 19 below a wellhead 10. The wellhead 10 provides valves, e.g., an upper master valve 18 and a lower master valve 11 that hydraulically close the production tubing 19. The outlet side of the upper master valve 18 may be hydraulically connected to a swab valve 12, which may be provided for entry of well intervention tools used to service the well. The wellhead 10 may comprise wing valves 14, 16 to enable well servicing and to control flow to a flow line 13 for disposition of fluids from the well. Once the well is sealed, the wellhead 10 may be lifted from the upper end of the production tubing 19 and a hanger spool 15 may be attached to the upper end of the production tubing 19. The hanger spool 15 provides a landing for a cable hanger and electrical connector assembly 17 and provides a fluid sealed path and electrical connections for an electrical connector cable 17B. The electrical connector cable 17B is in electrical communication with surface equipment (not shown) to provide power to the ESP and to communicate control signals and measurement data between the ESP 20 and the surface equipment.

When the hanger spool 15 is installed, the wellhead 10 may be reinstalled to the top of the hanger spool 15. The bridge plug (not shown) may then be removed and the ESP 20 inserted into the well at the end of the electrical cable 17A. When the ESP 20 approaches the intended setting depth in the production tubing 19, the electrical cable 17A may be cut and the electrical connector assembly 17 may be attached to the end of the severed electrical cable connected to the ESP 20. The severed electrical cable 17B and attached electrical connector assembly 17 may then be lowered until the electrical connector assembly 17 seats in the hanger spool 15. The electrical connector cable 17B may then be connected to the electrical connector assembly 17 so that operation of the ESP 20 may begin.

In order to perform the foregoing installation technique, several actions are required which may present disadvantages. First is the necessity of lifting the wellhead 10 to install the hanger spool 15. In some wells, particularly marine wells, lifting the wellhead 10 may require movement of the flow line 13. Moving the flow line 13 may be difficult and expensive. It is also the case that the hanger spool 15 may be a unique item for any particular well, thus requiring a long lead time to make the hanger spool 15 available for use on a particular well.

As stated above, it is also necessary to cut the electrical cable 17A to attach the electrical connector assembly 17. Thus, what remains is a length of electrical cable that may not be reusable for other purpose. Further, if later operation of the well requires moving the ESP 20 to a deeper depth in the well, the severed electrical cable would need to be replaced.

Further, attaching the electrical connector assembly 17 requires making electrical connections to the electrical conductors in the electrical cable 17A. In this way, personnel may be exposed to electric shock, and risk of injury or death, by reason of stray voltages generated by the ESP 20, in particular if the ESP 20 comprises a permanent magnet motor.

Accordingly, there is a need for improved techniques to deploy ESPs on electrical cable.

SUMMARY

One aspect of the present disclosure is a method for deploying a pump in a well. A method according to this aspect includes attaching a downhole barrier valve (DBV) to a spoolable conveyance. The DBV is closed to flow in both directions until a differential pressure across the DBV exceeds a first threshold. The DBV is closed to flow when the differential pressure falls below the first threshold. The DBV is moved to a selected depth in the well by extending the conveyance through a lubricator attached to a wellhead at an upper end of the production tubing. The spoolable conveyance is withdrawn from the well. The pump is attached to the electrical cable and is moved through the wellhead and the production tubing by extending the cable until the pump reaches a selected setting depth in the well.

In some embodiments, the lubricator is attached to the wellhead through a well pressure control valve (blowout preventer) assembly.

In some embodiments, the blowout preventer assembly comprises a grip and seal rams.

In some embodiments, the spoolable conveyance comprises the electrical cable.

In some embodiments, a master valve on the wellhead is opened after the lubricator is removed and before the pump is moved through the wellhead.

In some embodiments, the pump is latched onto the DBV.

In some embodiments, a seal and latch are disposed in the well above the DBV, and the pump is latched to the seal and latch.

In some embodiments, the DBV is closed to flow when the differential pressure exceeds a second threshold larger than the first threshold.

Other aspects and possible advantages will be apparent from the description and claims that follow.

DETAILED DESCRIPTION

Figure 1:
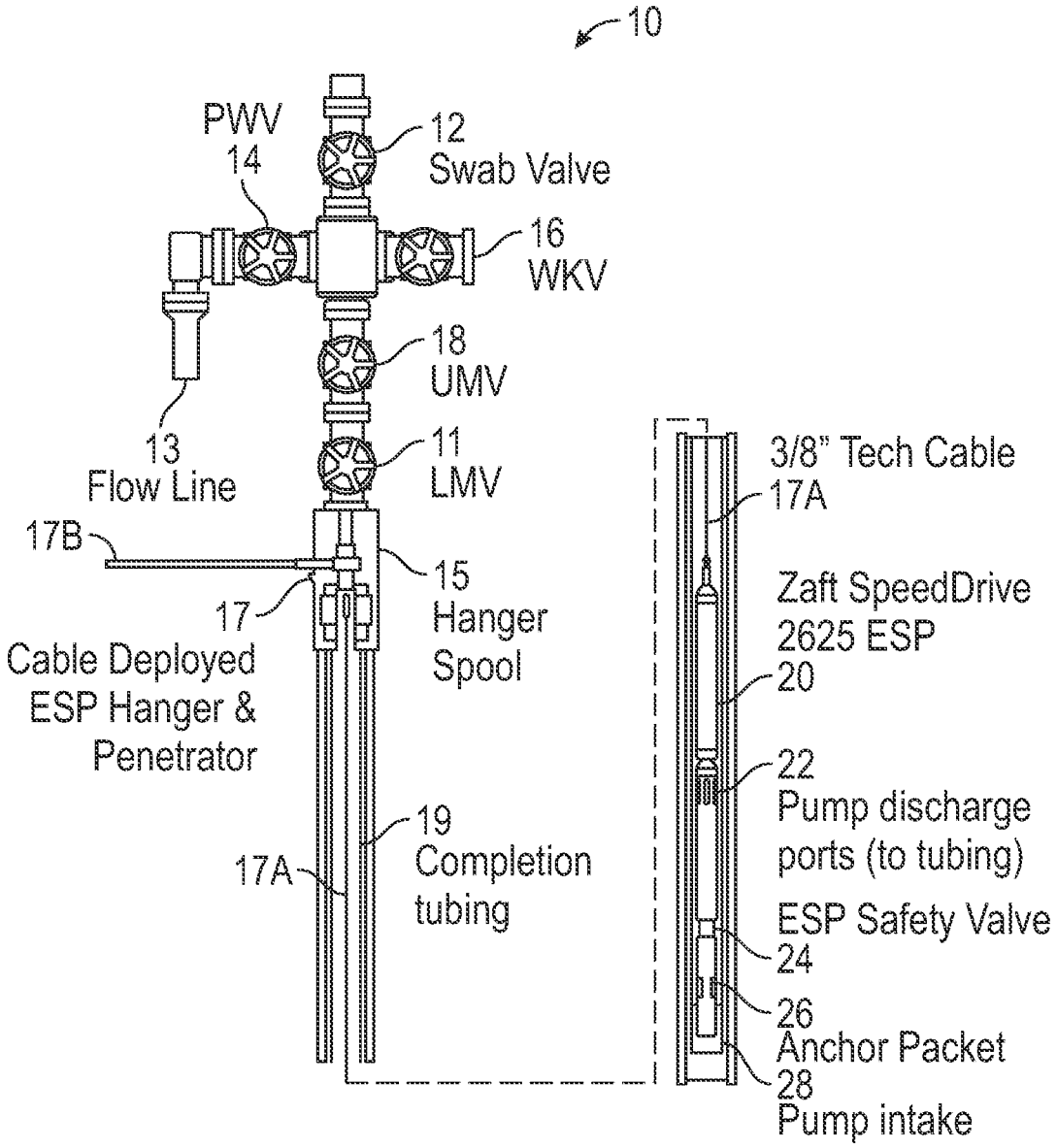
FIG. 1 (PRIOR ART)
FIG. 1 shows an example of an electric submersible pump (ESP) installed in a well using techniques known in the art.
Figure 2:
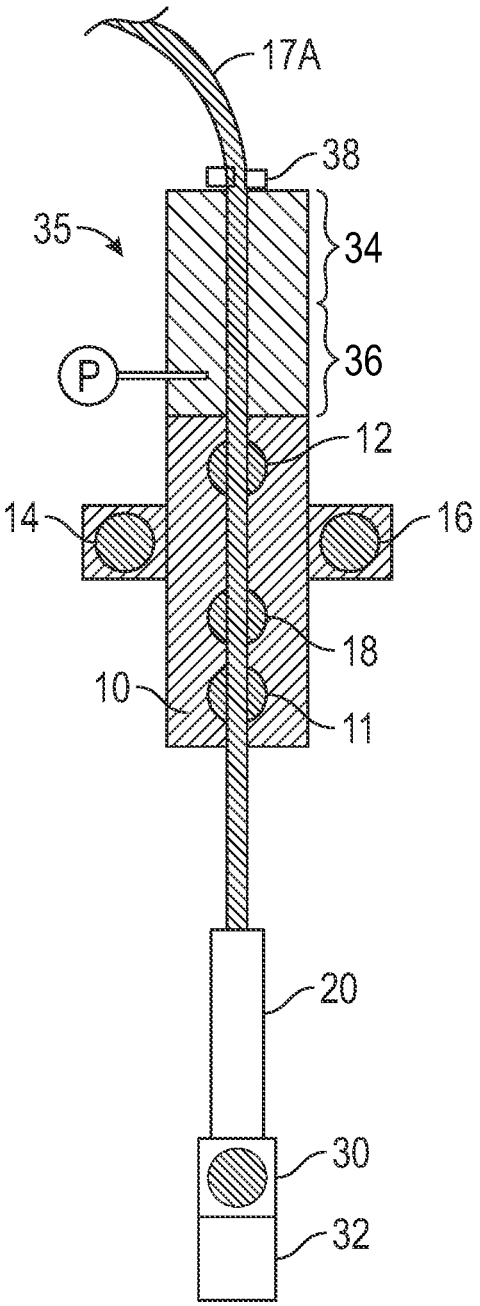
FIG. 2 shows schematically a method for installing an ESP according to the present disclosure.

FIG. 2 shows schematically an example embodiment of a method according to the present disclosure The wellhead 10 may remain attached to a casing head flange (not shown) at the top of a well casing (not shown) as would ordinarily be the state of the well after well construction is completed. Removing the wellhead 10 to install a hanger spool (15 in FIG. 1) is not necessary in a method according to the present disclosure. An electric submersible pump (ESP) 20 may be of a size and type intended to be deployed through a well production tubing (19 in FIG. 1). The ESP 20 may be attached to one end of an electrical cable 17A as would ordinarily be the case for deployment of an ESP on electrical cable. See, for example, U.S. Pat. No. 10,036,210 issued to Maclean et al. and incorporated herein by reference. The electrical cable 17A may be extended to enable lowering the ESP 20 in the well using a winch (see FIG. 3) or other spooling conveyance known in the art. Deploying the ESP 20 in the well using the electrical cable 17A will be explained in more detail below.

First, a downhole barrier valve (DBV) 30 and associated annular seal (packer) 32 may be coupled to one end of a spoolable conveyance of any type known in the art for deploying tools in a well. Such conveyance may include electrical cable, slickline or coiled tubing. In the present example embodiment, the spoolable conveyance may be the electrical cable 17A as a matter of convenience and to minimize the surface equipment required to deploy the ESP 20. The DBV 30 may have the following characteristics. The DBV 30 may be normally closed to fluid flow in either direction, opening to flow only when a predetermined differential pressure across the DBV 30 is obtained. The DBV 30 may close to flow when the differential pressure exceeds a selected threshold in either direction across the DBV 30, and may close when the differential pressure drops below the selected threshold. In some embodiments the DBV 30 may close to flow when the differential pressure exceeds a different, larger threshold. An example embodiment of the DBV 30 may be one sold under model designation ESPSV (electric submersible pump safety valve) by Pragma, Wellheads Crescent, Dyce, Aberdeen, AB21 7GA, United Kingdom.

To deploy the DBV 30 in the well, it may be coupled to a packer 32 for simultaneous deployment in the well using the spoolable conveyance (e.g., electrical cable 17A). To deploy the DBV 30 and the packer 32 in the well, a conventional lubricator (not shown), packing seal 38 and well pressure control valve (blowout preventer) assembly 35 may be attached to the wellhead 10 above the swab valve 12. The DBV 30 and packer 32 may be attached to the free end of the electrical cable 17A, disposed in the lubricator, and then the swab valve 12 and master valves 11, 18 are opened. The electrical cable 17A may then be extended until the packer 32 and DBV 30 move through the wellhead 10 and through the production tubing (19 in FIG. 1) until they are located at the intended pump deployment position in the well, which may be within the production tubing (19 in FIG. 1).

With the packer 32 and DBV 30 thus in place, and the DBV 30 closed, the packer 32 may be set to lock the packer 32 and DBV 30 in place in the well. The spoolable conveyance (electrical cable 17A) may be disconnected from the DBV 30 and then withdrawn from the well. The lubricator and cable packing seal may be removed from the wellhead 10, e.g., from the blowout preventer assembly.

Because of the presence of the closed DBV 30 in the well, it is possible to open the master valves 11, 18, the swab valve 12 and rams in a blowout preventer assembly (explained below) to deploy the ESP 20 in the well without the need for an enclosing lubricator above the top of the wellhead 10. It will be appreciated that the assembled DBV 30 and packer 32 may be considerably shorter than the ESP 20, particularly a pump with a large number of pump stages and having an outer diameter enabling passage through the production tubing (19 in FIG. 1). As a result, being able to deploy the ESP without such length lubricator may prove convenient during deployment and later retrieval.

In the present example embodiment, the blowout preventer assembly 35 may be a "grip and seal" type blowout preventer assembly, which may comprise shear rams 36 and a plurality of grip and seal rams 34. The blowout preventer assembly may be assembled to the wellhead 10 above the swab valve 12. An electrical cable packing seal (such as a high pressure grease injector) 38 may be assembled to the top of the rod lock rams 34 to provide a pressure seal through which the electrical cable 17A may be moved. If the electrical cable 17A is used to deploy the DBV 30 and packer 32, the same packing seal 38 may be used for both deploying the DBV/packer and the ESP 20. In the present example embodiment, it is not necessary to include the lubricator (not shown) between the rod lock rams 34 and the cable packing seal 38 to enclosed the ESP 20 prior to opening any or all of the swab valve 12, upper master valve 18 and lower master valve 11. In some embodiments, the electrical cable 17A may have a smooth exterior surface for improved sealing, and have an internal pressure barrier to reduce the possibility of pressure leakage through the electrical cable 17A in the event its exterior surface becomes damaged or penetrated during deployment in the well. By using the rod lock rams 34, it is possible to deploy the ESP 20, into the well safely without the use of a full length lubricator to enclose the ESP 20, as previously explained with reference to deploying the DBV 30 and the packer 32.

Once the foregoing valves in the wellhead 10 are opened, the electrical cable 17A may be extended to lower the ESP 20 into the well. Once the ESP 20 reaches the intended setting depth in the well, a latch (not shown separately) may be actuated to seal within the production tubing (19 in FIG. 1) and to lock the ESP 20 into place in the well. In some embodiments, the pump setting depth may be at the depth of the DBV 30. The electrical cable 17A may be electrically connected to surface equipment (not shown) in order to operate the ESP 20 in the ordinary manner. It will be appreciated that when the ESP 20 is started, differential pressure across the ESP 20 will be developed that is within a range required to open the DBV 30 so that fluids may be moved to surface just as would be the case without the DBV 30. In some embodiments, in the event of pump failure or the formation causing unexpected rapid inflow of fluid into the well (a "kick") the DBV 30 may close, preventing damage to the ESP 20 and risk to the well, as well as risk to equipment and personnel at the surface.

In some embodiments, the DBV 30 and packer 32 may be set at a selected depth in the well. The DBV 30 and packer 32 may be deployed as explained above. To deploy the ESP 20, an annular seal and latch (not shown) may be attached to the spoolable conveyance (e.g., the electrical cable 17A) and the annular seal and latch may be deployed in the well to a shallower depth than the depth of the DBV 30 and packer 32. The ESP 20 may be attached to such annular seal and latch (not shown) and thereby run into the well and set at the shallower depth along with the annular seal and latch (not shown). In some embodiments, the annular seal and latch may be deployed in the well separately, The ESP 20 may then be moved into the well as previously explained until the ESP 20 reaches the latch, whereupon the ESP 20 is latched in the annular seal/latch (not shown). In such embodiments, it may be easier to stop uncontrolled influx of fluid into the well ("kill" a "kick") because of the additional length of well in which to establish hydrostatic head by pumping high density liquid (kill fluid) into the well. In some situations such as failure of well barriers it may be required to pump high density liquid (kill fluid) into the well using known methods.

Figure 3:
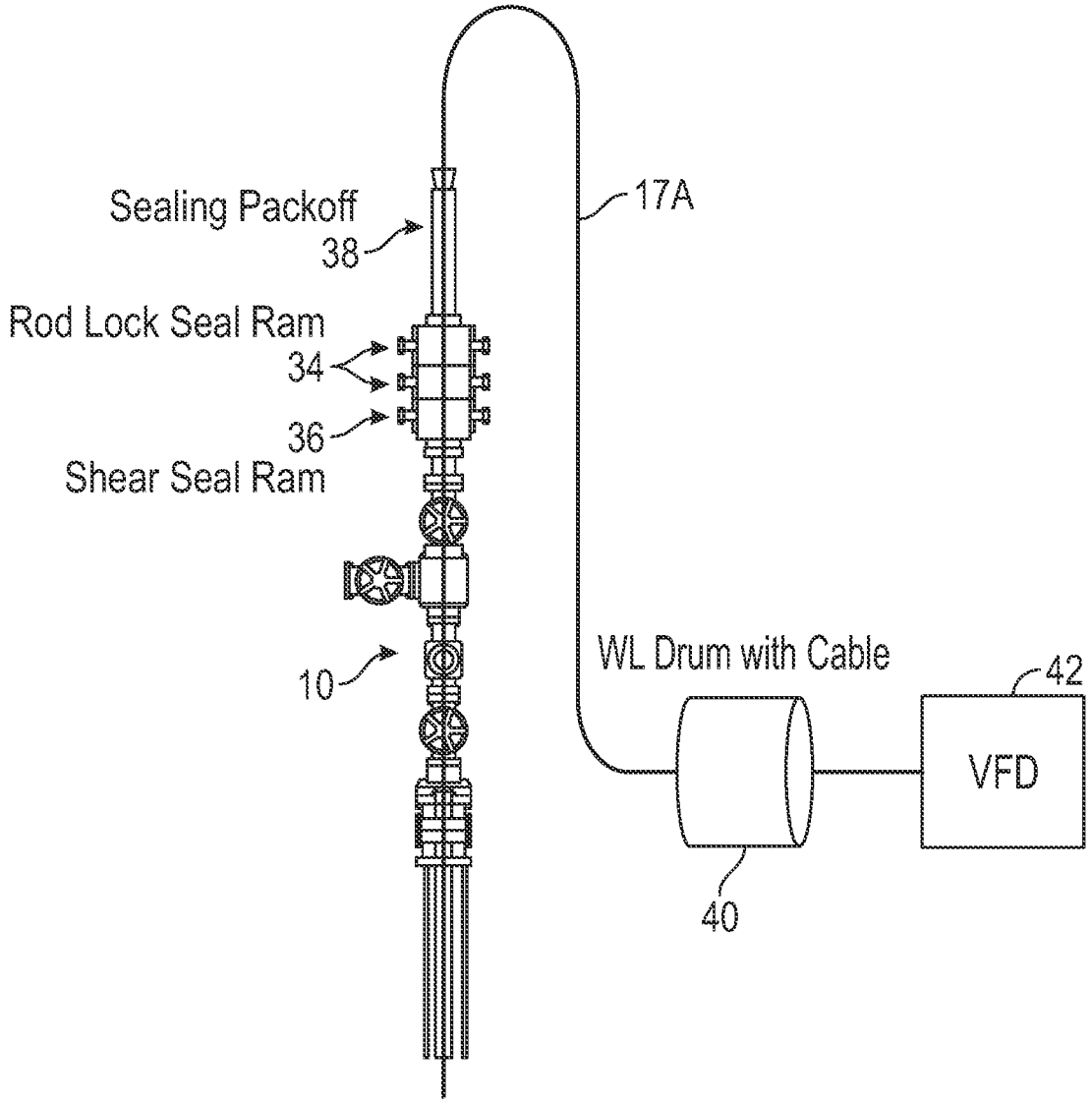
FIG. 3 shows a temporary use of an ESP in a well for possible later retrieval without the need to cut the electrical cable.

In some embodiments, the ESP (20 in FIG. 2) may be left in the well with the electrical cable 17A attached in the same manner is was used to deploy the ESP (20 in FIG. 2) in the well while the ESP is operated. Referring to FIG. 3, in some embodiments, a winch unit (not shown) to which is attached and selectably rotates a drum 40 of the electrical cable 17A may be removed from the well location, leaving the drum 40 and remaining electrical cable 17A spooled thereon, while an end of the electrical cable 17A may be connected to the previously described surface equipment 42. The foregoing may remain at the well location until it is desired either to deploy the ESP (20 in FIG. 2) at a different depth in the well or to retrieve the ESP (20 in FIG. 2) from the well. In such case, the winch unit (not shown) may be returned to the well location, reattached to the drum 40 and the electrical cable 17A spooled as needed. The ESP 20, DBV 20, packer 32 and electrical cable 17A cable may be re-deployed in the well with a different ESP or with the ESP 20 reconfigured or may be deployed in another well if desired without the need to cut the electrical cable 17A.

Using a method as described herein, it is unnecessary to provide a hanger spool in a well between the wellhead and the casing head flange. The foregoing enables deploying an ESP without the need to lift the wellhead or move connected lines such as the flow line. Such method also enables operating the ESP without the need to cut and terminate the electrical cable, thus saving long length electrical cable for reuse, and reducing exposure of personnel to electric shock by reason of handling exposed electrical conductors in the electrical cable. Eliminating the need to cut and terminate the electrical cable makes possible deployment of an ESP for short term evaluation of ESP performance and possible reconfiguration of the ESP if and as needed to be re-deployed in the well, or deployment in a different well.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method of deploying a pump in a well production tubing using an electrical cable, comprising:

attaching a downhole barrier valve (DBV) to a spoolable conveyance, the DBV closed to flow in either an upward direction or a downward direction, the DBV opening to flow only when a predetermined differential pressure across the DBV is obtained, the DBV closed to flow when a differential pressure across the DBV exceeds a predetermined threshold in either the upward direction or the downward direction, and the DBV closed to flow when the differential pressure falls below the predetermined threshold;

moving the DBV to a first selected depth in the well by extending the spoolable conveyance through a lubricator attached to a wellhead at an upper end of the production tubing and setting the DBV at the selected depth;

withdrawing the spoolable conveyance from the well;

attaching the pump to the electrical cable; and moving the pump through the wellhead and through the production tubing by extending the electrical cable until the pump reaches a pump setting depth in the well.

2. The method of claim 1 wherein the lubricator is attached to the wellhead through a blowout preventer assembly comprising a well pressure control valve assembly.

3. The method of claim 2 wherein the blowout preventer assembly comprises a grip and seal blowout preventer assembly.

4. The method of claim 1 wherein the spoolable conveyance comprises the electrical cable.

5. The method of claim 1 wherein a master valve on the wellhead is opened after the lubricator is removed and before the pump is moved through the wellhead.

6. The method of claim 1 wherein the pump setting depth is the first selected depth.

7. The method of claim 1 wherein the pump setting depth is a second selected depth shallower than the first selected depth.

* * * * *